US011839235B2

(12) United States Patent
Hua et al.

(10) Patent No.: US 11,839,235 B2
(45) Date of Patent: Dec. 12, 2023

(54) ULTRASONIC ELECTRONIC CIGARETTE ATOMIZER

(71) Applicant: PAPA HEALTH. INC, City of Industry, CA (US)

(72) Inventors: Jian Hua, Guangdong (CN); Xuefeng Song, Guangdong (CN)

(73) Assignee: PAPA HEALTH. INC, City of Industry, CA (US)

( * ) Notice: Subject to any disclaimer, the term of this patent is extended or adjusted under 35 U.S.C. 154(b) by 701 days.

(21) Appl. No.: 15/733,522

(22) PCT Filed: Oct. 31, 2019

(86) PCT No.: PCT/CN2019/114848
§ 371 (c)(1),
(2) Date: Aug. 19, 2020

(87) PCT Pub. No.: WO2021/042474
PCT Pub. Date: Mar. 11, 2021

(65) Prior Publication Data

US 2021/0368862 A1 Dec. 2, 2021

(30) Foreign Application Priority Data

Sep. 6, 2019 (CN) ..... 201910843316.X

(51) Int. Cl.
*A24F 40/10* (2020.01)
*A24F 40/05* (2020.01)
(Continued)

(52) U.S. Cl.
CPC ..... *A24F 40/05* (2020.01); *A24F 40/10* (2020.01); *A24F 40/42* (2020.01); *A24F 40/44* (2020.01);
(Continued)

(58) Field of Classification Search
CPC ..... A24F 40/05; A24F 40/10; A24F 40/42; A24F 40/44; A24F 40/485; B05B 17/0653
See application file for complete search history.

(56) References Cited

U.S. PATENT DOCUMENTS 9,072,322 B2 * 7/2015 Liu ..... A24F 40/485
9,867,399 B1 * 1/2018 Liu ..... A24F 40/42
(Continued)

FOREIGN PATENT DOCUMENTS

CN 205432145 U 8/2016
CN 105962421 A 9/2016
(Continued)

OTHER PUBLICATIONS

ISA/CN, PCT International Search Report and Written Opinion dated May 27, 2020 issued in PCT International Application No. PCT/CN2019/114848.

*Primary Examiner* — Thanh Tam T Le
(74) *Attorney, Agent, or Firm* — Gottlieb, Rackman & Reisman, P.C.

(57) ABSTRACT

An ultrasonic atomizer including a shell, a sealing cover, a base, a through pipe, an outer connecting ring, an inner connecting ring, an outer loudspeaker cover, a butt-joint pipe, an inner loudspeaker cover and an atomization mechanism, wherein the through pipe is arranged on the shell, the outer connecting ring is arranged at a corresponding position of the through pipe, the inner connecting ring is arranged inside the through pipe, the outer loudspeaker cover is arranged inside the shell, and an end portion of the outer loudspeaker cover penetrates out of the sealing cover and extends outside so as to be connected with the base, the butt-joint pipe is arranged inside the through pipe, the inner loudspeaker cover is connected with an end portion of the
(Continued)

butt-joint pipe, and the atomization mechanism is arranged inside the base.

7 Claims, 7 Drawing Sheets

(51) Int. Cl.

| | |
|---|---|
| ***A24F 40/485*** | (2020.01) |
| ***A24F 40/44*** | (2020.01) |
| ***A24F 40/42*** | (2020.01) |
| ***B05B 17/06*** | (2006.01) |

(52) U.S. Cl.
CPC ..... *A24F 40/485* (2020.01); *B05B 17/0653* (2013.01)

(56) References Cited

U.S. PATENT DOCUMENTS

| | | | | |
|---|---|---|---|---|
| 9,877,517 | B2 * | 1/2018 | Liu | A24F 40/44 |
| 9,955,731 | B2 * | 5/2018 | Liu | H05B 3/44 |
| 10,506,827 | B2 * | 12/2019 | Guo | A24F 40/05 |
| 10,874,807 | B2 * | 12/2020 | Liu | A61M 15/0085 |
| 10,881,146 | B2 * | 1/2021 | Qiu | A24F 40/00 |
| 10,980,284 | B2 * | 4/2021 | Lin | A24F 40/42 |
| 11,219,245 | B2 * | 1/2022 | Liu | A24F 40/40 |
| 11,259,568 | B2 * | 3/2022 | Qiu | A24F 40/49 |

FOREIGN PATENT DOCUMENTS

| | | | |
|---|---|---|---|
| CN | 106037013 | A | 10/2016 |
| CN | 205757212 | U | 12/2016 |
| CN | 206025225 | U | 3/2017 |
| CN | 206949536 | U | 2/2018 |
| CN | 108142998 | A | 6/2018 |
| WO | 2018163366 | A1 | 9/2018 |

* cited by examiner

ULTRASONIC ELECTRONIC CIGARETTE ATOMIZER

CROSS-REFERENCE TO RELATED APPLICATIONS

This application is a national stage filing under 35 U.S.C. § 371 of international application number PCT/CN2019/114848, filed Oct. 31, 2019, which claims priority to Chinese patent application No. 201910843316.X filed Sep. 6, 2019. The contents of these applications are incorporated herein by reference in their entirety.

FIELD

The disclosure relates to the field of medical instruments, and more particularly, to an ultrasonic atomizer.

BACKGROUND

One of important applications for atomizer is electronic cigarette, which is intended to convert tobacco tar containing nicotine and other components into mist and then supply the mist to a user for smoking. This form of use replaces use of traditional tobacco, so that smokers may gradually reduce their dependence on tobacco-based cigarettes, thus finally achieving the purpose of smoking cessation. At present, the tobacco tar is easy to be sucked out during smoking of the electronic cigarette in the market. In addition, if the electronic cigarette is repeatedly filled with tobacco tar, a liquid storage tank may not be cleaned completely, resulting in a possibility of taint of odor.

SUMMARY

In view of the above problems, the disclosure is intended to provide an ultrasonic atomizer which, when used in an electronic cigarette, is convenient to dismantle and replace, and avoids cross-use of tobacco tar smell.

In order to achieve the above objective, the disclosure provides an ultrasonic atomizer, which includes a shell, a sealing cover, a base, a through pipe, an outer connecting ring, an inner connecting ring, an outer loudspeaker cover, a butt-joint pipe, an inner loudspeaker cover and an atomization mechanism, wherein the sealing cover is arranged on a bottom portion of the shell, the base is arranged below the sealing cover, the through pipe, which is provided with an air nozzle in an end portion and communicated with an interior of the shell, is arranged on the shell, the outer connecting ring extending into the shell is arranged at a corresponding position of the through pipe, the inner connecting ring spaced by a certain distance from the through pipe and connected with the air nozzle is arranged inside the through pipe, the outer loudspeaker cover connected with the outer connecting ring is arranged inside the shell, and an end portion of the outer loudspeaker cover penetrates out of the sealing cover and extends outside so as to be connected with the base, the butt-joint pipe connected with the inner connecting ring, extending into the shell and spaced by a certain distance from the outer loudspeaker cover is arranged inside the through pipe, the inner loudspeaker cover spaced by a certain distance from the outer loudspeaker cover is connected with an end portion of the butt-joint pipe, and the atomization mechanism respectively connected with the end portion of the outer loudspeaker cover and an end portion of the inner loudspeaker cover is arranged inside the base. Both sides of the through pipe are respectively provided with an air inlet. A top cover with an external thread is arranged on an outer side of the end portion of the outer loudspeaker cover, the top cover is connected with an internal thread arranged in an inner side of the base, an inner space formed by the top cover and the base is an atomization chamber, and the top cover is provided with a plurality of liquid inlets communicated with the atomization chamber. The atomization chamber is respectively communicated with the outer loudspeaker cover and the inner loudspeaker cover. The atomization mechanism includes an ultrasonic atomizing part arranged on a bottom portion of the base in the atomization chamber, a hollow bottom frame arranged on the ultrasonic atomizing part, a top pressing frame arranged on the hollow bottom frame with a shape corresponding to the hollow bottom frame and a hollow central position, and atomizing cotton in an interlayer between the hollow bottom frame and the top pressing frame. A plurality of liquid seepage holes are annularly distributed on a side surface of the hollow bottom frame. The atomizing cotton at the hollow position of the hollow bottom frame is contacted with the ultrasonic atomizing part under a flattening action of the top pressing frame at the hollow position.

In some embodiments, the base is provided with a positive electrode guide block which passes through the base and is contacted with the ultrasonic atomizing part, and the ultrasonic atomizing part is provided with a negative electrode guide sheet.

In some embodiments, a tobacco tar storage bin for storing tobacco tar is formed between the outer loudspeaker cover and an inner wall of the shell, the shell is provided with a liquid adding port communicated with the tobacco tar storage bin, and the tobacco tar storage bin is communicated with the atomization chamber through the liquid inlets. Gaps are formed between the outer loudspeaker cover and the butt-joint pipe as well as the inner loudspeaker cover, and are communicated with the atomization chamber, gap communication is formed between the air inlet and the outer loudspeaker cover as well as the butt-joint pipe, and between the outer loudspeaker cover and the inner loudspeaker cover, the air nozzle is communicated with the butt-joint pipe and the inner loudspeaker cover through the inner connecting ring, and the air inlet and the air nozzle are respectively communicated with the atomization chamber. Therefore, three channels are formed throughout the internal structure, the first channel is the tobacco tar storage bin for storing the tobacco tar formed between the outer loudspeaker cover and the inner wall of the shell, and the tobacco tar storage bin is communicated with the atomization chamber, which means that the tobacco tar enters the atomization chamber from the seepage holes, infiltrates into the atomizing cotton and is fully contacted with the ultrasonic atomizing part; the second channel is the gaps formed between the outer loudspeaker cover and the butt-joint pipe as well as the inner loudspeaker cover, and communicated with the atomization chamber, and air enters the atomization chamber through the air inlet and then is fully contacted with the atomizing cotton; and the third channel is that the atomizing cotton with the tobacco tar above the ultrasonic atomizing part generates an atomized liquid through oscillation of the ultrasonic atomizing part, and under an action of artificial suction, the atomized liquid is sucked out from the inner loudspeaker cover and the butt-joint pipe, and finally sucked out from the air nozzle through the inner connecting ring.

In some embodiments, a holder communicated with the air nozzle is arranged on the through pipe; and both sides of the holder are respectively provided with a side through hole communicated with the air inlet.

In some embodiments, an inner side of the top cover located at a position of the outer loudspeaker cover is provided with a blocking ring for blocking a condensate from going up from the outer loudspeaker cover.

In some embodiments, a first sealing ring is arranged between the outer loudspeaker cover and the outer connecting ring, a second sealing ring is arranged between the shell and the sealing cover, and a third sealing ring is arranged between the top cover with the external thread and the base with the internal thread.

In some embodiments, the liquid inlet is provided with a seal closure.

The disclosure has the beneficial effects of being convenient to dismantle and replace, and avoiding cross-use of tobacco tar smell. Specifically, (1) the atomizing cotton (or ultrasonic non-woven fabric) is replaced at will by using a structure that the top cover with the external thread arranged on the end portion of the outer loudspeaker cover is connected with the base with the internal thread, thus being convenient to disassemble, and avoiding different odor residues of the atomizing cotton after replacing the tobacco tar during use, which means that the atomizing cotton has the residues after a first tube of tobacco tar is smoked out, thus avoiding a possibility of taint of odor during use. (2) The atomizing cotton at the hollow bottom frame is pressed by the hollow structure of the top pressing frame during use of the atomizing cotton, so that the atomizing cotton is contacted with the ultrasonic part in a large area, and the atomizing cotton at a central position may not bulge upwardly due to suction during inhaling, thus achieving the purpose of full atomization. (3) After entering the air inlets on both sides, an air flow is expanded by the outer loudspeaker cover, and then is contacted with the atomizing cotton by 360 degrees. In addition, the inner side of the top cover located at the position of the outer loudspeaker cover above the atomization chamber is provided with the blocking ring for blocking the condensate from going up from the outer loudspeaker cover, with the purpose of blocking the condensate from going up.

DETAILED DESCRIPTION OF THE EMBODIMENTS

The disclosure is further described in detail hereinafter with reference to the accompanying drawings.

Figure 1:
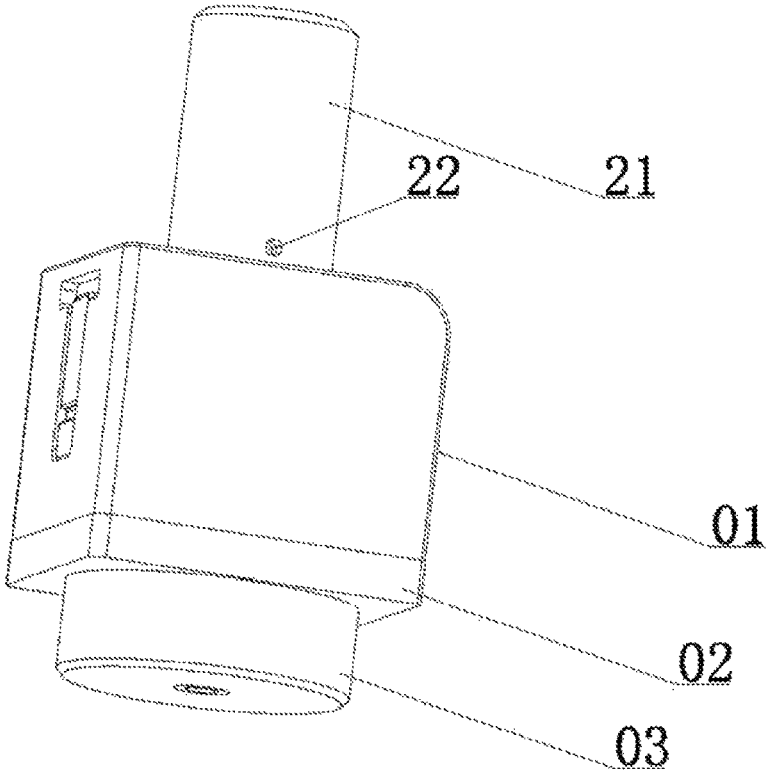
FIG. 1 is a structure diagram of the disclosure.
Figure 2:
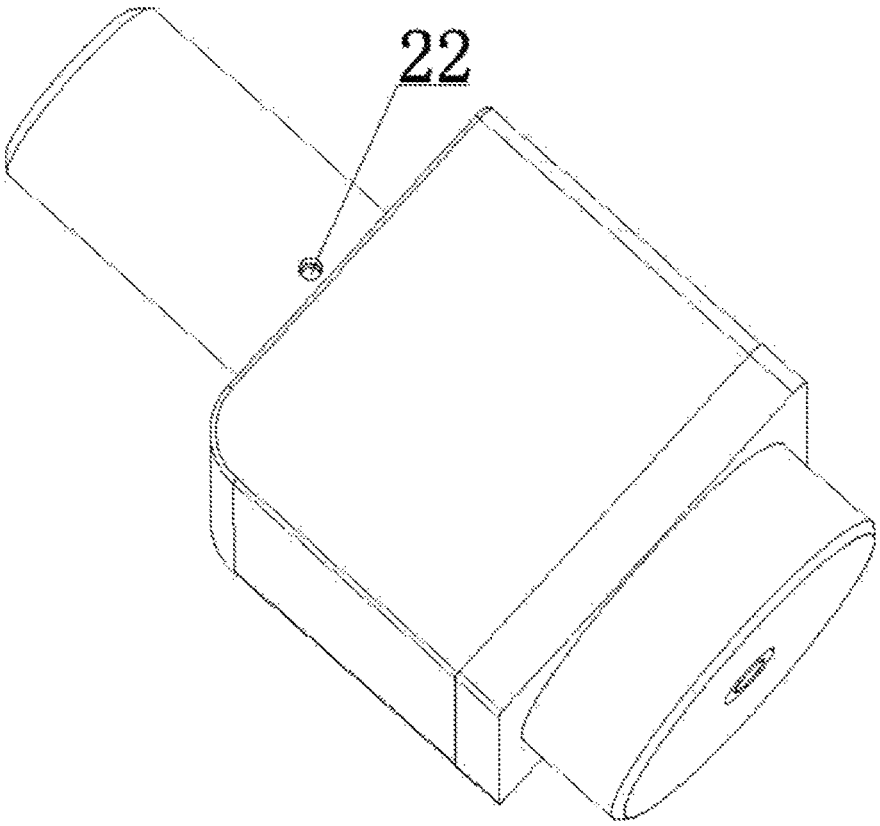
FIG. 2 is a structure diagram of another view of the disclosure.
Figure 3:
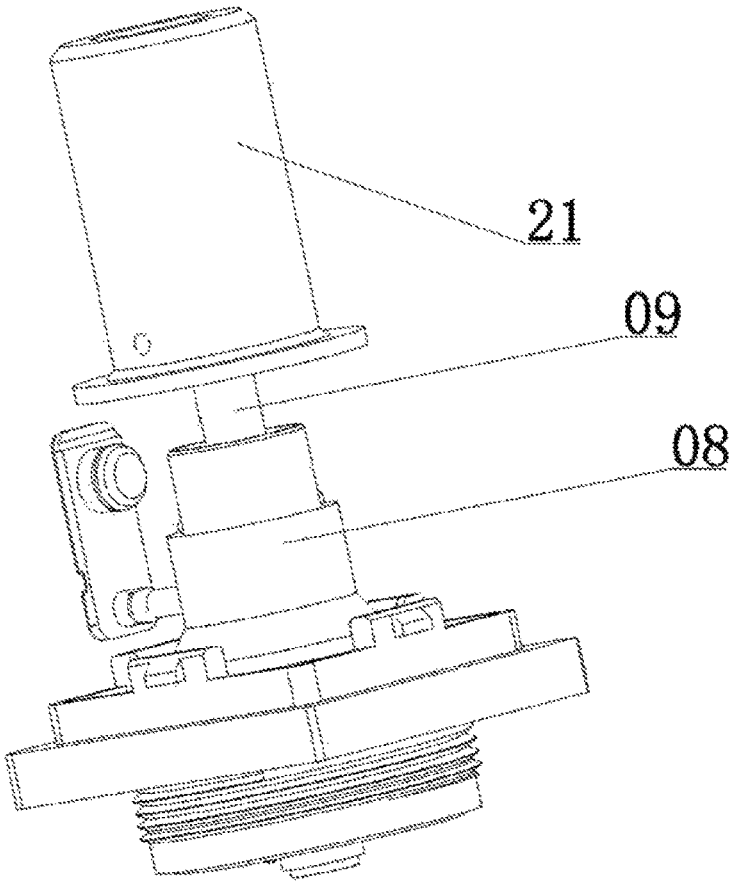
FIG. 3 is an internal structure diagram of the disclosure.
Figure 4:
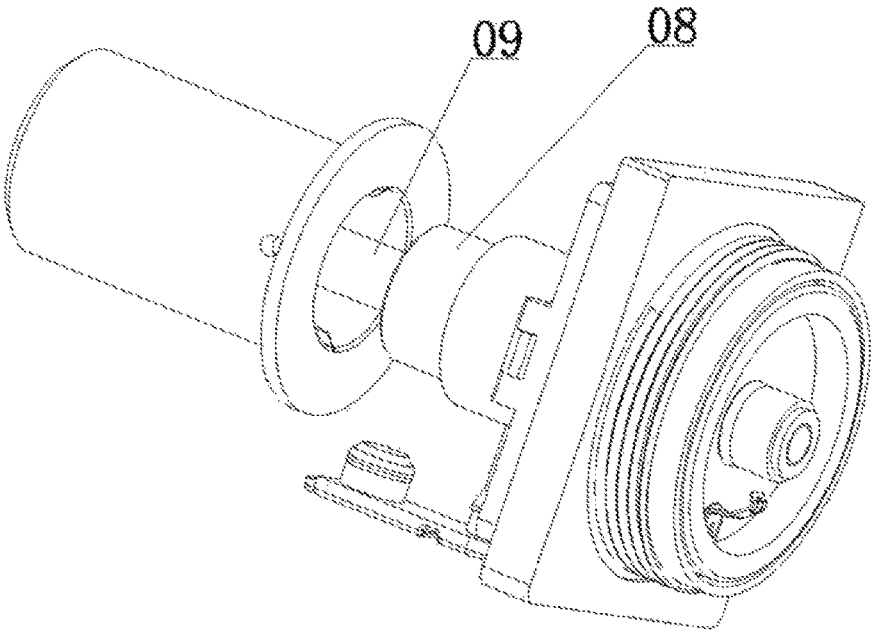
FIG. 4 is an internal structure diagram of another view of the disclosure.
Figure 5:
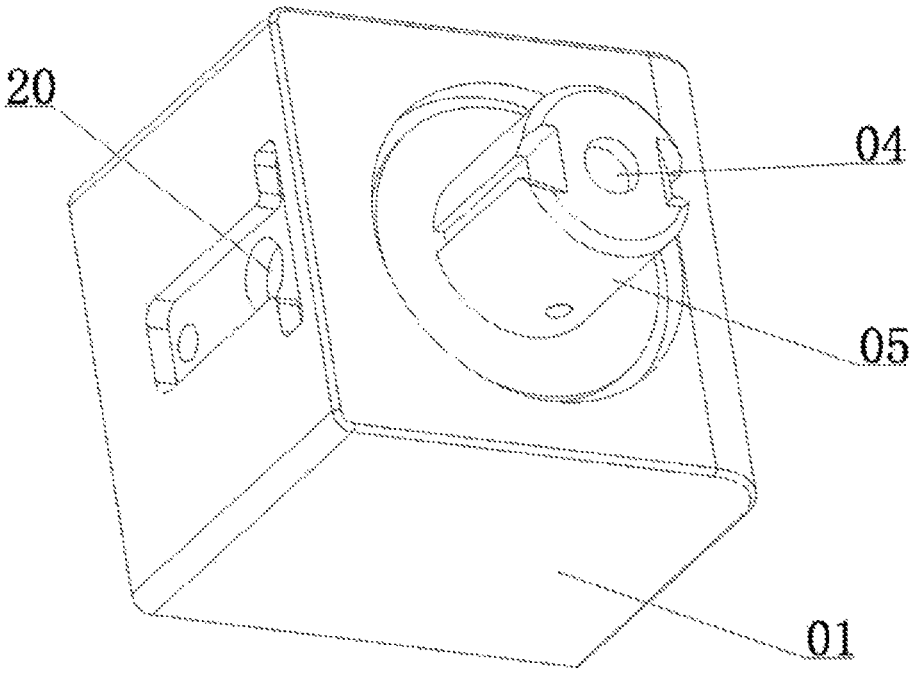
FIG. 5 is a structure diagram of a shell of the disclosure.
Figure 6:
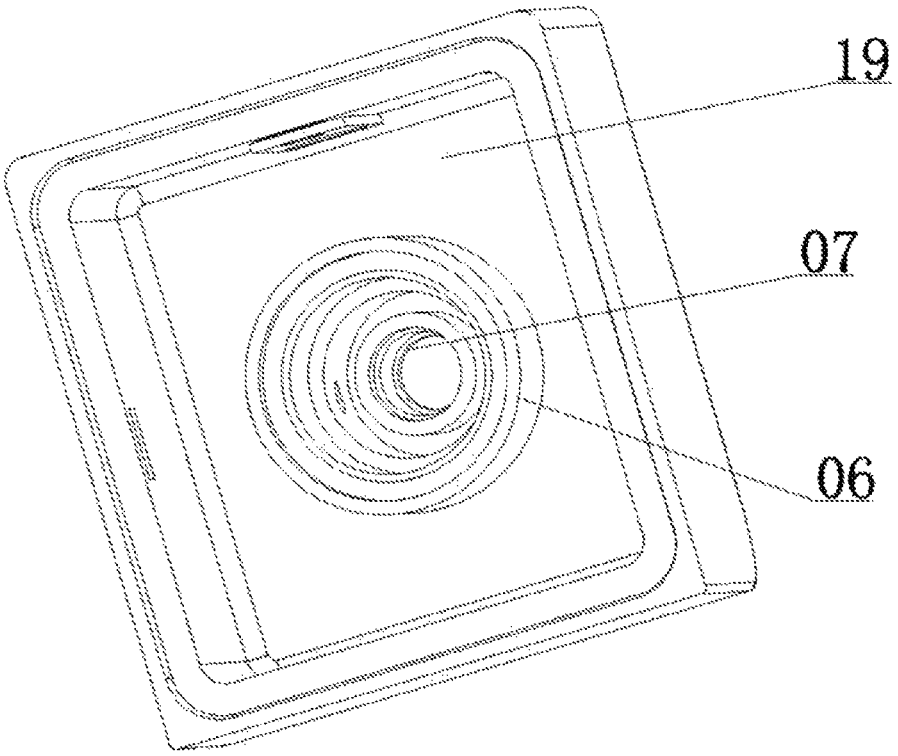
FIG. 6 is a structure diagram of a bottom view of the shell of the disclosure.
Figure 7:
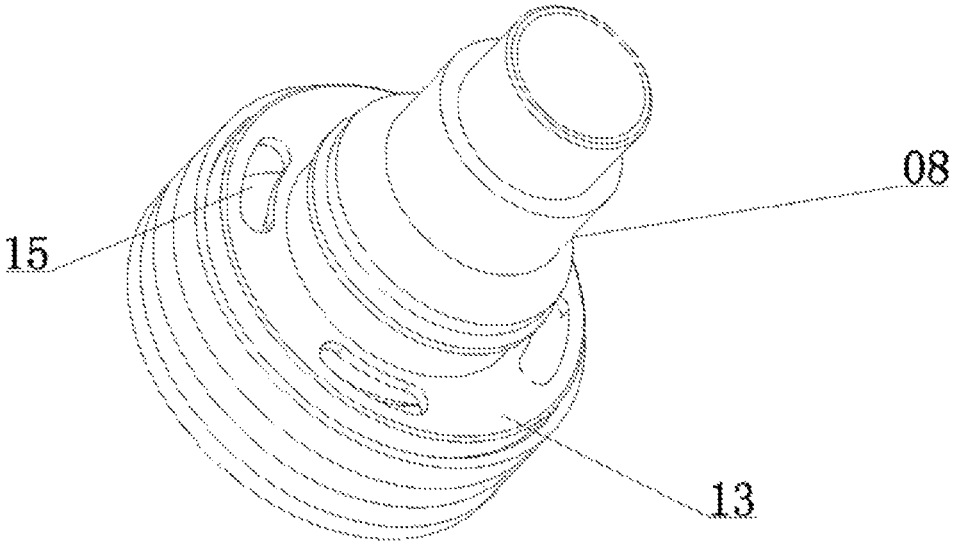
FIG. 7 is a structure diagram of an outer loudspeaker cover of the disclosure.
Figure 8:
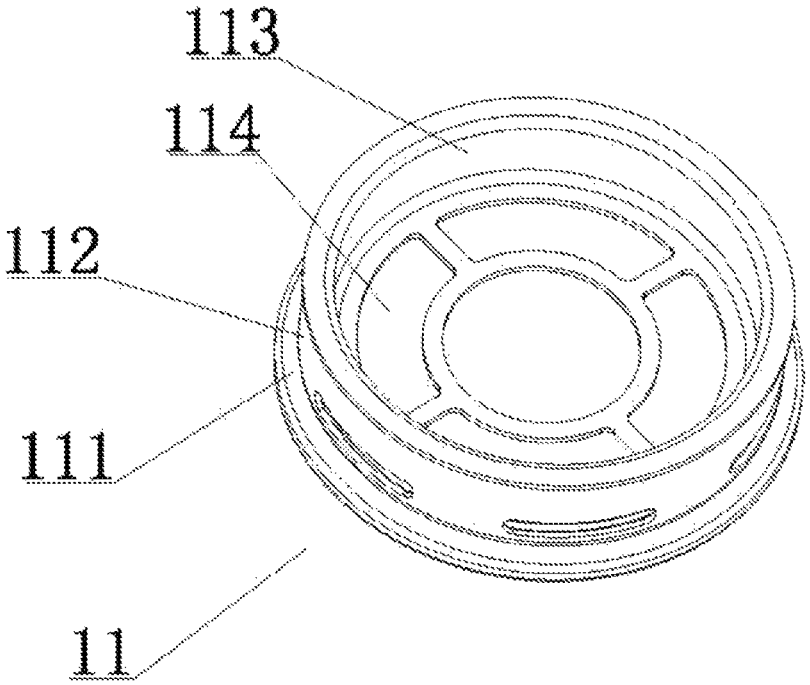
FIG. 8 is a structure diagram of an atomization mechanism of the disclosure.
Figure 9:
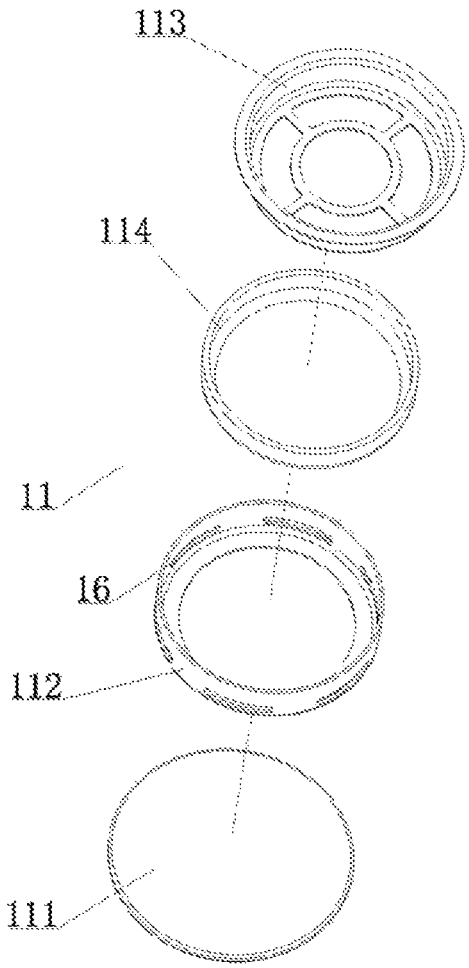
FIG. 9 is an explosive structure diagram of FIG. 8.
Figure 10:
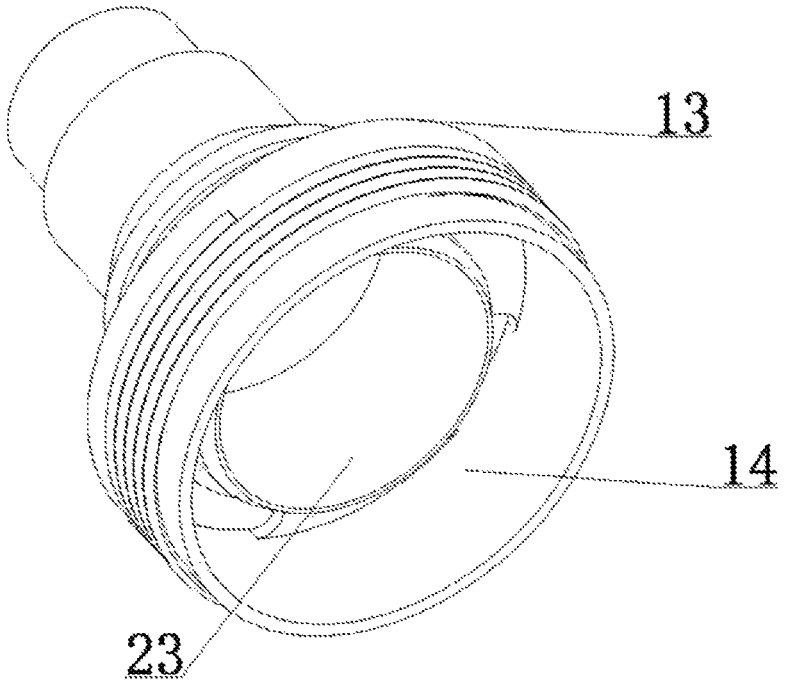
FIG. 10 is an internal structure diagram of the outer loudspeaker cover of the disclosure.
Figure 11:
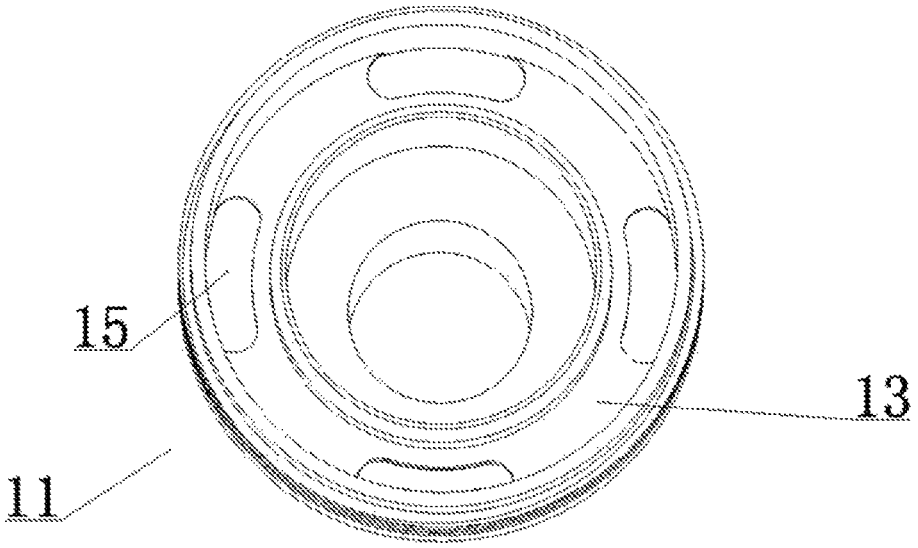
FIG. 11 is a structure diagram of a bottom view of the outer loudspeaker cover of the disclosure.
Figure 12:
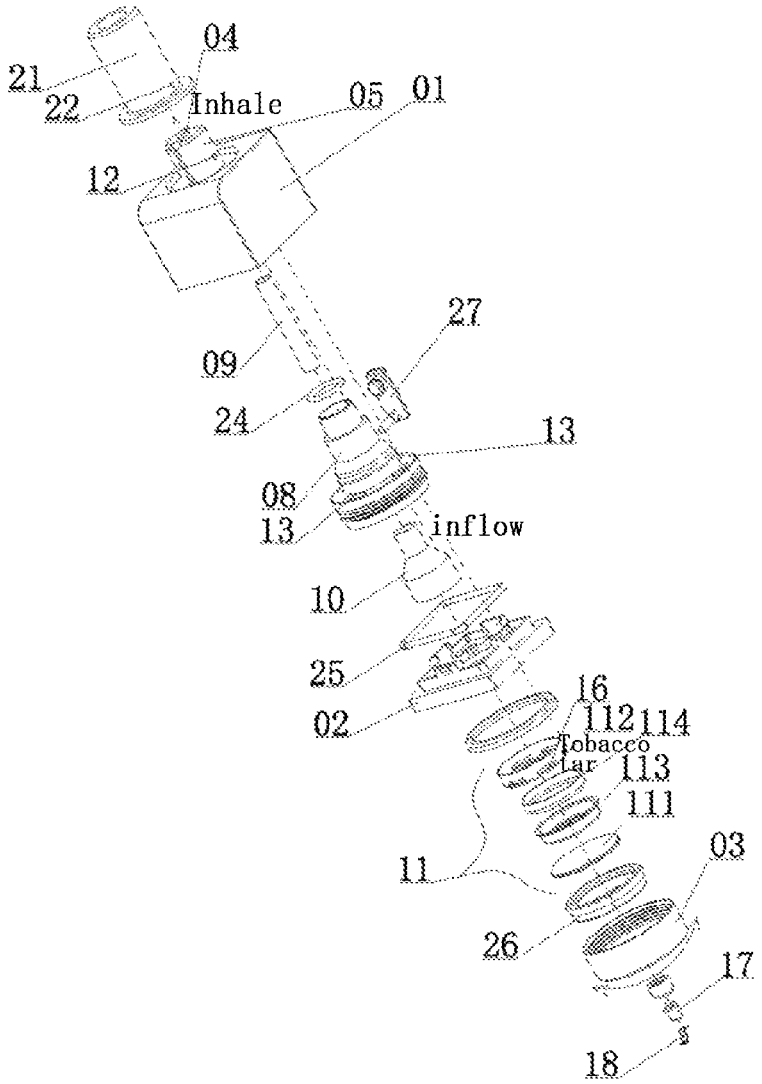
FIG. 12 is an explosive structure diagram of the disclosure.

As shown in FIG. 1 to FIG. 12, an ultrasonic atomizer includes a shell 01, a sealing cover 02, a base 03, a through pipe 05, an outer connecting ring 06, an inner connecting ring 07, an outer loudspeaker cover 08, a butt-joint pipe 09, an inner loudspeaker cover 10 and an atomization mechanism 11. The sealing cover 02 is arranged on a bottom portion of the shell 01. The base 03 is arranged below the sealing cover 02. The through pipe 05, which is provided with an air nozzle 04 in an end portion and communicated with an interior of the shell 01, is arranged on the shell 01. The outer connecting ring 06 extending into the shell 01 is arranged at a corresponding position of the through pipe 05. The inner connecting ring 07 spaced by a certain distance from the through pipe 05 and connected with the air nozzle 04 is arranged inside the through pipe 05. The outer loudspeaker cover 08 connected with the outer connecting ring 06 is arranged inside the shell 01, and an end portion of the outer loudspeaker cover 08 penetrates out of the sealing cover 02 and extends outside so as to be connected with the base 03. The butt-joint pipe 09 connected with the inner connecting ring 07, extending into the shell 01 and spaced by a certain distance from the outer loudspeaker cover 08 is arranged inside the through pipe 05. The inner loudspeaker cover 10 spaced by a certain distance from the outer loudspeaker cover 08 is connected with an end portion of the butt-joint pipe 09. The atomization mechanism 11 respectively connected with the end portion of the outer loudspeaker cover 08 and an end portion of the inner loudspeaker cover 10 is arranged inside the base 03. Both sides of the through pipe 05 are respectively provided with an air inlet 12. A top cover 13 with an external thread is arranged on an outer side of the end portion of the outer loudspeaker cover 08. The top cover 13 is connected with an internal thread arranged in an inner side of the base 03. An inner space formed by the top cover 13 and the base 03 is an atomization chamber 14. The top cover 13 is provided with a plurality of liquid inlets 15 communicated with the atomization chamber 14. The atomization chamber 14 is respectively communicated with the outer loudspeaker cover 08 and the inner loudspeaker cover 10. The atomization mechanism 11 includes an ultrasonic atomizing part 111 arranged on a bottom portion of the base 03 in the atomization chamber 14, a hollow bottom frame 112 arranged on the ultrasonic atomizing part 111, a top pressing frame 113 arranged on the hollow bottom frame 112 with a shape corresponding to the hollow bottom frame 112 and a hollow central position, and atomizing cotton 114 in an interlayer between the hollow bottom frame 112 and the top pressing frame 113. A plurality of liquid seepage holes 16 are annularly distributed on a side surface of the hollow bottom frame 12. The atomizing cotton 114 at the hollow position of the hollow bottom frame 112 is contacted with the ultrasonic atomizing part 111 under a flattening action of the top pressing frame 113 at the hollow position.

The base 03 is provided with a positive electrode guide block 17 which passes through the base 03 and is contacted with the ultrasonic atomizing part 111. The ultrasonic atomizing part 111 is provided with a negative electrode guide sheet 18. A tobacco tar storage bin 19 for storing tobacco tar is formed between the outer loudspeaker cover 08 and an inner wall of the shell 01. The shell 01 is provided with a liquid adding port 20 communicated with the tobacco tar storage bin 19. The tobacco tar storage bin 19 is communicated with the atomization chamber 14 through the liquid inlets 15. Gaps are formed between the outer loudspeaker cover 08 and the butt-joint pipe 09 as well as the inner loudspeaker cover 10, and are communicated with the atomization chamber 14. Gap communication is formed between the air inlet 12 and the outer loudspeaker cover 08 as well as the butt-joint pipe 09, and between the outer loudspeaker cover 08 and the inner loudspeaker cover 10. The air nozzle 04 is communicated with the butt-joint pipe 09 and the inner loudspeaker cover 10 through the inner connecting ring 07. The air inlet 12 and the air nozzle 04 are respectively communicated with the atomization chamber 14. Three channels are formed throughout the internal structure. The first channel is the tobacco tar storage bin 19 for storing the tobacco tar formed between the outer loudspeaker cover 08 and the inner wall of the shell 01, and the tobacco tar storage bin 19 is communicated with the atomization chamber 14, which means that the tobacco tar enters the atomization chamber 14 from the seepage holes 16, infiltrates into the atomizing cotton 114 and is fully contacted with the ultrasonic atomizing part 111. The second channel is the gaps formed between the outer loudspeaker cover 08 and the butt-joint pipe 09 as well as the inner loudspeaker cover 10, and communicated with the atomization chamber 14, and air enters the atomization chamber 14 through the air inlet 12 and then is fully contacted with the atomizing cotton 114. The third channel is that the atomizing cotton 114 with the tobacco tar above the ultrasonic atomizing part 111 generates an atomized liquid through oscillation of the ultrasonic atomizing part 111, and under an action of artificial suction, the atomized liquid is sucked out from the inner loudspeaker cover 10 and the butt-joint pipe 09, and finally sucked out from the air nozzle 04 through the inner connecting ring 07. A holder 21 communicated with the air nozzle 04 is arranged on the through pipe 05. Both sides of the holder 21 are respectively provided with a side through hole 22 communicated with the air inlet 12. An inner side of the top cover 13 located at a position of the outer loudspeaker cover 08 is provided with a blocking ring 23 for blocking a condensate from going up from the outer loudspeaker cover 08. A first sealing ring 24 is arranged between the outer loudspeaker cover 08 and the outer connecting ring 06. A second sealing ring 25 is arranged between the shell 01 and the sealing cover 02. A third sealing ring 26 is arranged between the top cover 13 with the external thread and the base 03 with the internal thread. The liquid inlet 15 is provided with a seal closure 27.

During application, the atomizing cotton 114 (or ultrasonic non-woven fabric) is replaced at will by using a structure that the top cover 13 with the external thread arranged on the end portion of the outer loudspeaker cover 08 is connected with the base 03 with the internal thread, thus being convenient to disassemble, and avoiding different odor residues of the atomizing cotton 114 after replacing the tobacco tar during use, which means that the atomizing cotton 114 has the residues after a first tube of tobacco tar is smoked out, thus avoiding a possibility of taint of odor during use. The atomizing cotton 114 at the hollow bottom frame 112 is pressed by the hollow structure of the top pressing frame 113 during use of the atomizing cotton 114, so that the atomizing cotton 114 is contacted with the ultrasonic part in a large area, and the atomizing cotton 114 at a central position may not bulge upwardly due to suction during inhaling, thus achieving the purpose of full atomization. After entering the air inlets 12 on both sides, an air flow is expanded by the outer loudspeaker cover 08, and then is contacted with the atomizing cotton 114 by 360 degrees. In addition, the inner side of the top cover 13 located at the position of the outer loudspeaker cover 08 above the atomization chamber is provided with the blocking ring 23 for blocking the condensate from going up from the outer loudspeaker cover 08, with the purpose of blocking the condensate from going up.

The above embodiments are only some embodiments of the disclosure. Those of ordinary skills in the art may further make several modifications and improvements without departing from the inventive concept of the disclosure, and these modifications and improvements all fall within the scope of protection of the disclosure.

The invention claimed is:

1. An ultrasonic atomizer, comprising a shell, a sealing cover, a base, a through pipe, an outer connecting ring, an inner connecting ring, an outer loudspeaker cover, a butt-joint pipe, an inner loudspeaker cover and an atomization mechanism, wherein, the sealing cover is arranged on a bottom portion of the shell, the base is arranged below the sealing cover, the through pipe, which is provided with an air nozzle in an end portion and communicated with an interior of the shell, is arranged on the shell, the outer connecting ring extending into the shell is arranged at a corresponding position of the through pipe, the inner connecting ring spaced by a certain distance from the through pipe and connected with the air nozzle is arranged inside the through pipe, the outer loudspeaker cover connected with the outer connecting ring is arranged inside the shell, and an end portion of the outer loudspeaker cover penetrates out of the sealing cover and extends outside so as to be connected with the base, the butt-joint pipe connected with the inner connecting ring, extending into the shell and spaced by a certain distance from the outer loudspeaker cover is arranged inside the through pipe, the inner loudspeaker cover spaced by a certain distance from the outer loudspeaker cover is connected with an end portion of the butt-joint pipe, and the atomization mechanism respectively connected with the end portion of the outer loudspeaker cover and an end portion of the inner loudspeaker cover is arranged inside the base;

both sides of the through pipe are respectively provided with an air inlet;

a top cover with an external thread is arranged on an outer side of the end portion of the outer loudspeaker cover; the top cover is connected with an internal thread arranged in an inner side of the base; an inner space formed by the top cover and the base is an atomization chamber;

and the top cover is provided with a plurality of liquid inlets communicated with the atomization chamber;

the atomization chamber is respectively communicated with the outer loudspeaker cover and the inner loudspeaker cover;

the atomization mechanism comprises an ultrasonic atomizing part arranged on a bottom portion of the base in the atomization chamber, a hollow bottom frame arranged on the ultrasonic atomizing part, a top pressing frame arranged on the hollow bottom frame with a shape corresponding to the hollow bottom frame and a hollow central position, and atomizing cotton in an interlayer between the hollow bottom frame and the top pressing frame; and a plurality of liquid seepage holes are annularly distributed on a side surface of the hollow bottom frame; and the atomizing cotton at the hollow position of the hollow bottom frame is contacted with the ultrasonic atomizing part under a flattening action of the top pressing frame at the hollow position.

2. The ultrasonic atomizer of claim 1, wherein the base is provided with a positive electrode guide block which passes through the base and is contacted with the ultrasonic atomizing part; and the ultrasonic atomizing part is provided with a negative electrode guide sheet.

3. The ultrasonic atomizer of claim 2, wherein a tobacco tar storage bin for storing tobacco tar is formed between the outer loudspeaker cover and an inner wall of the shell; the shell is provided with a liquid adding port communicated with the tobacco tar storage bin; and the tobacco tar storage bin is communicated with the atomization chamber through the liquid inlets;

gaps are formed between the outer loudspeaker cover and the butt-joint pipe as well as the inner loudspeaker cover, and are communicated with the atomization chamber; and gap communication is formed between the air inlet and the outer loudspeaker cover as well as the butt-joint pipe, and between the outer loudspeaker cover and the inner loudspeaker cover;

the air nozzle is communicated with the butt-joint pipe and the inner loudspeaker cover through the inner connecting ring; and the air inlet and the air nozzle are respectively communicated with the atomization chamber.

4. The ultrasonic atomizer of claim 1, wherein a cigarette holder communicated with the air nozzle is arranged on the through pipe; and both sides of the cigarette holder are respectively provided with a side through hole communicated with the air inlet.

5. The ultrasonic atomizer of claim 1, wherein an inner side of the top cover located at a position of the outer loudspeaker cover is provided with a blocking ring for blocking a condensate from going up from the outer loudspeaker cover.

6. The ultrasonic atomizer of claim 1, wherein a first sealing ring is arranged between the outer loudspeaker cover and the outer connecting ring; a second sealing ring is arranged between the shell and the sealing cover; and a third sealing ring is arranged between the top cover with the external thread and the base with the internal thread.

7. The ultrasonic atomizer of claim 1, wherein the liquid inlet is provided with a seal closure.

* * * * *